United States Patent [19]

Capella et al.

[11] 4,235,600

[45] Nov. 25, 1980

[54] METHOD OF AND APPARATUS FOR DECONTAMINATING RADIOACTIVE GARMENTS

[75] Inventors: Joseph A. Capella, Gainesville, Fla.; Dennis R. Morrison, Kemah, Tex.

[73] Assignee: Health Physics Systems, Inc., Gainsville, Fla.

[21] Appl. No.: 959,009

[22] Filed: Nov. 9, 1978

[51] Int. Cl.[2] ..... B08B 3/00

[52] U.S. Cl. ..... 8/137; 8/137.5; 8/139; 8/141; 8/142; 68/18 R

[58] Field of Search ..... 8/142, 137, 137.5, 139, 8/141

[56] References Cited

U.S. PATENT DOCUMENTS

| | | | |
|---|---|---|---|
| 2,998,326 | 8/1961 | Ellenbogen et al. | 8/142 |
| 3,635,656 | 1/1972 | Piepmeyer | 8/142 |
| 3,728,074 | 4/1973 | Victor | 252/162 |
| 3,933,425 | 1/1976 | Grünwalder et al. | 8/142 |

*Primary Examiner*—Melvyn I. Marquis
*Attorney, Agent, or Firm*—Bernard A. Reiter

[57] ABSTRACT

Garments are deposited in a cleaning drum and the drum is agitated during a wash cycle. A dry cleaning solvent is continuously added to the drum during the wash cycle and continuously removed from the drum during the wash cycle to flush the radioactive particulate material separated from the garments into a sump. The solvent is pumped from the sump for addition to the drum during the wash cycle and the pumped solvent is filtered to remove substantially all of the radioactive particulate material suspended in the solvent.

The apparatus for decontaminating the radioactive garments comprises a sump for supporting a dry cleaning solvent. A drum for supporting the radioactively contaminated garments during a wash cycle which separates the radioactive particulate material from the garments means are provided for continuously pumping the dry cleaning solvent from the sump to the drum and for continuously removing the solvent and separated particulate material from the drum into the sump. A filtering means is used to continuously remove substantially all of the particulate material suspended in the solvent that is carried to the drum.

14 Claims, 4 Drawing Figures

METHOD OF AND APPARATUS FOR DECONTAMINATING RADIOACTIVE GARMENTS

BACKGROUND AND BRIEF SUMMARY OF THE INVENTION

The present invention relates generally to a method of and apparatus for decontaminating radioactive garments, and more specifically, the removal of radioactive dust, dirt, grease, oil, water and loose surface contamination from protective clothing and accessory protective articles by dry cleaning such articles.

The conventional method of cleaning radioactive particulate material from industrial worker's protective clothing is a conventional wet laundry wash. This wash entails a standard 30 to 45 minute water washing using commercial detergents followed by a separate drying cycle (usually 60 minutes) in a conventional hot air or other type textile clothes dryer. This system normally is so inefficient that from twenty (20%) percent to thirty-five (35%) of the protective clothing must be rewashed because insufficient radioactivity has been removed to permit reuse of the protective article. Moreover, approximately three (3) gallons of contaminated wash water is generated per 16 pounds of clothing washed. This water must be diluted to a safe concentration before it is released or evaporated to a concentrate, and then drummed and buried at an approved radiation waste burial facility. This makes the process very costly and time consuming. Further, the conventional wet laundry involves the wash cycle followed by a separate drying cycle in a hot air dryer. In the event that insufficient radioactive particulate is removed, the heat fixes the contaminated dirt to the cloth fibers which makes successive cleanings much less efficient and results in an early discard of the protective garments.

In an effort to eliminate some of these difficulties, dry cleaning systems have been suggested which use hydrocarbon solvents. Conventionally, these solvents have a relatively low boiling point, such as that of perchloroethylene, and the vapors from such materials have been hazardous to the personnel operating such cleaning systems. Moreover, the conventional dry cleaning systems, such as discosed in U.S. Pat. No. 3,728,074, have not provided any better cleaning results than the conventional wet wash system.

Accordingly, it is a primary object of the present invention to provide a method of and apparatus for decontaminating radioactive garments by using a dry cleaning solvent which continuously flushes the radioactive particulate material separated from the garment into a sump during the wash cycle.

Further, it is an object of the present invention to provide a method of and apparatus for decontaminating radioactive garments in a single apparatus which dries the garments after completion of the wash cycle.

Further, it is an object of the present invention to provide a method of and apparatus for decontaminating radioactive garments which continuously flushes the garments with circulating solvent during the wash cycle and adds a clean solvent to the drum at the beginning of the wash cycle to dilute any radioactive contamination within the re-cycled solvent.

Further, it is an object of the present invention to provide a method of and apparatus for decontaminating radioactive garments which removes any radioactive particulate material settling out of the re-cycling solvent.

Further, it is an object of the present invention to provide a method of and apparatus for monitoring the amount of radioactivity in the re-cycling solvent to ensure that adequate filtering removes the radioactive particulate material from such solvent.

Further, it is an object of the present invention to provide a method of and apparatus for decontaminating radioactive garments which uses 0.5 micron filters for continuously filtering re-cycled solvent during both wash and dry cycles to remove substantially all of the radioactive particulate material suspended in such solvent.

Further, it is an object of the present invention to provide a method of and apparatus for filtering the solvent upon removal from a drum which agitates the garments during the wash cycle for removing lint from such solvent before it is continuously filtered.

In accordance with the invention, a method of decontaminating radioactive garments comprises the steps of depositing the garments in a cleaning drum or cage and agitating the drum during a wash cycle. Further, a dry cleaning solvent is continuously added to the drum during the wash cycle and continuously removed therefrom to flush radioactive particulate material separated from the garments into a sump. The solvent is then pumped from the sump to the drum for use to continuously flush the radioactive particulate matter therefrom. During such pumping, the solvent is filtered to remove substantially all of the radioactive particulate material suspended in the solvent.

Further, in accordance with the invention, an apparatus for decontaminating radioactive garments comprises a drum for supporting the radioactively contaminated garments during wash and dry cycles. Means are used for continuously flushing any radioactive material separated from the garments out of the drum during the wash cycle with a dry cleaning solvent. A sump receives the solvent and the material flushed out of the drum and the solvent is filtered to remove the radioactive particulate materials suspended therein prior to the solvent being used to again flush the radioactive material out of the drum.

Further, in accordance with the invention, apparatus is provided for decontaminating radioactive garments which comprises a sump for storing a dry cleaning solvent and a drum for agitating the radioactively contaminated garments during a wash cycle which separates radioactive particulate material from the garments. The dry cleaning solvent is continuously pumped from the sump to the drum and the solvent and separated particulate material is continuously removed from the drum into the sump. The dry cleaning solvent which is continuously pumped to the drum is filtered to remove substantially all of the particulate material from the solvent which permits the solid entrapped radioactive waste and filter to be the main item of disposal at an approved radiation waste disposal facility.

BRIEF DESCRIPTION OF THE DRAWINGS

Other objects and advantages of the invention will become apparent upon reading the following detailed description and upon reference to the drawings, in which like reference characters are used throughout to indicate like parts.

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

DETAILED DESCRIPTION OF THE INVENTION

Figure 1:
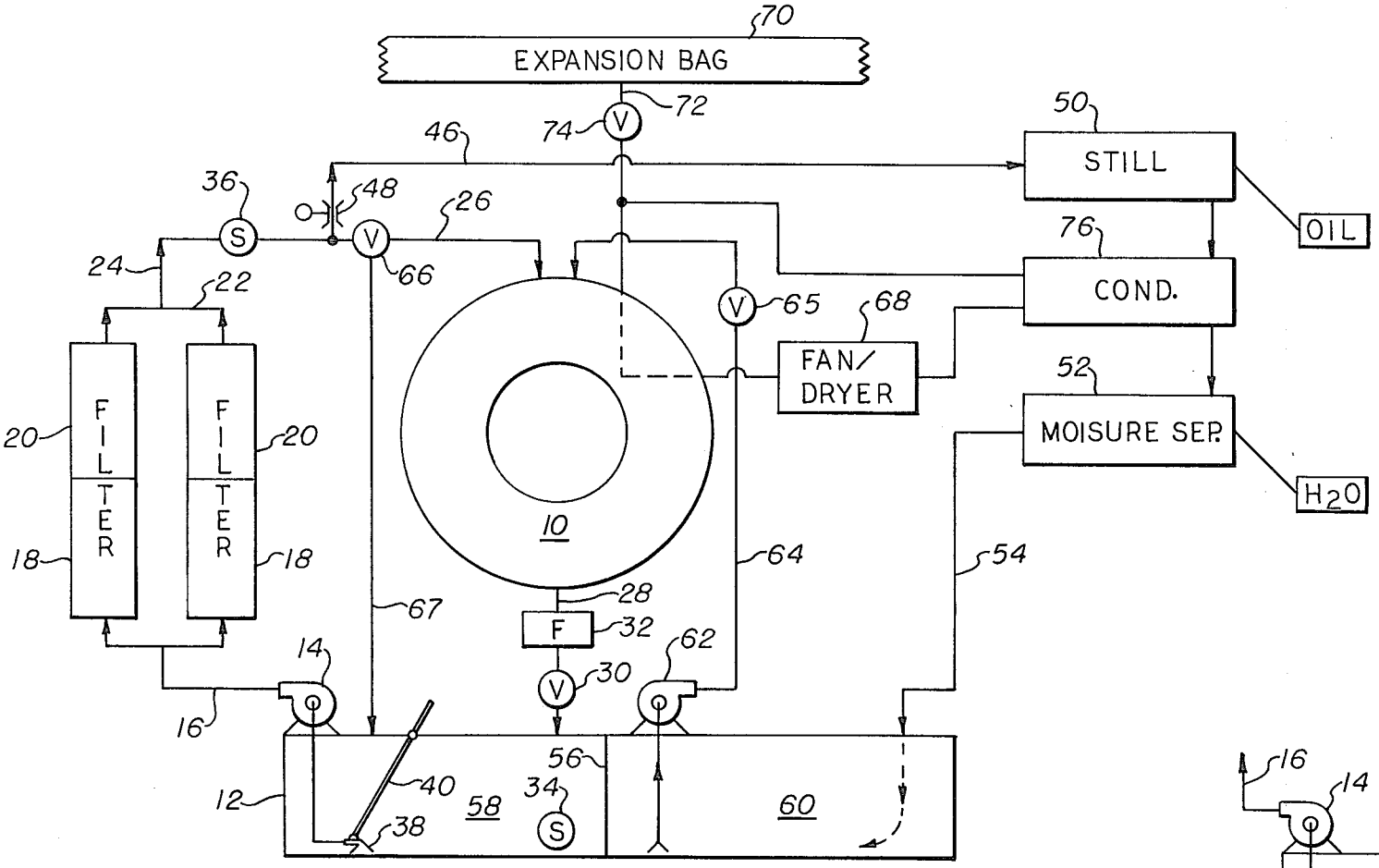
FIG. 1 is a schematic view of apparatus constructed according to the present invention.

Turning first to FIG. 1, there is shown a schematic illustration of a dry cleaning system constructed according to the present invention. Such arrangement is a modification of the device disclosed in U.S. Pat. No. 3,728,074, by Irving Victor, the disclosure therein being incorporated in this Application by reference.

The dry cleaning apparatus of this invention includes a rotatable cleaning cage or drum 10 wherein the contaminated radioactive garments are deposited and which agitates during both the wash and dry cycles. The garments are cleaned in the drum by continuously flushing them with a dry cleaning solvent during the wash cycle by providing a sump 12 in fluid communication with the drum and using a pump 14 to force the solvent received in sump 12 through conduits 16 to parallel filters 18 and 20, and through conduits 22, 24 and 26 into the top of drum 10. Disposed in the bottom of drum 10 is an outlet conduit 28 which permits withdrawal of the dry cleaning solvent and any radioactive particulate material separated from the garments during the wash cycle. A valve 30 is provided in conduit 28 to permit the passage of fluid through conduit 28 into sump 12 during the wash cycle and prevent any passage of fluids into sump 12 during the drying cycle. Filters 18 and 20 are arranged in series in with filter 20 of sufficiently small size to remove substantially all of the radioactive particulate material suspended in the solvent. It has been found when filters 20 have opening sizes of 0.5 microns the radioactive particulate is adequately removed from the solvent. Since these filters are of relatively small size, a removable and disposable filter 32 is installed in conduit 28 to remove contaminated lint and prevent blockage of the filters 18 and 20. It has been found that a fine wire screen, such as a window screen, may be used to eliminate such contaminated lint.

Radiation sensors 34 and 36 are provided in sump 12 and conduit 24, respectively, to permit monitoring of the solvent being re-cycled to ensure that filters 18 and 20 are filtering satisfactorally.

Since dense or heavy metal oxides may separate from the solvent contained in sump 12, the inlet of pump 14 is movable such as by rod 40 for moving across the bottom of the sump to pick up such dense material for carrying to filters 18 and 20 and separation from the solvent.

Figure 2:
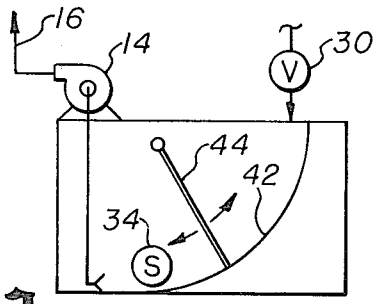
FIG. 2 is another embodiment of a portion of the invention shown in FIG. 1.

As shown in FIG. 2, a second embodiment is provided wherein sump 12 has an arcuate bottom 42 disposed beneath outlet conduit 28 so that the dense material will roll down toward inlet 38 of pump 14. A wiper 44 is pivotally mounted to sump 12 for sweeping the particulate matter toward inlet 38 in the event the particulate matter should become stuck to arcuate bottom 42.

Figure 3:
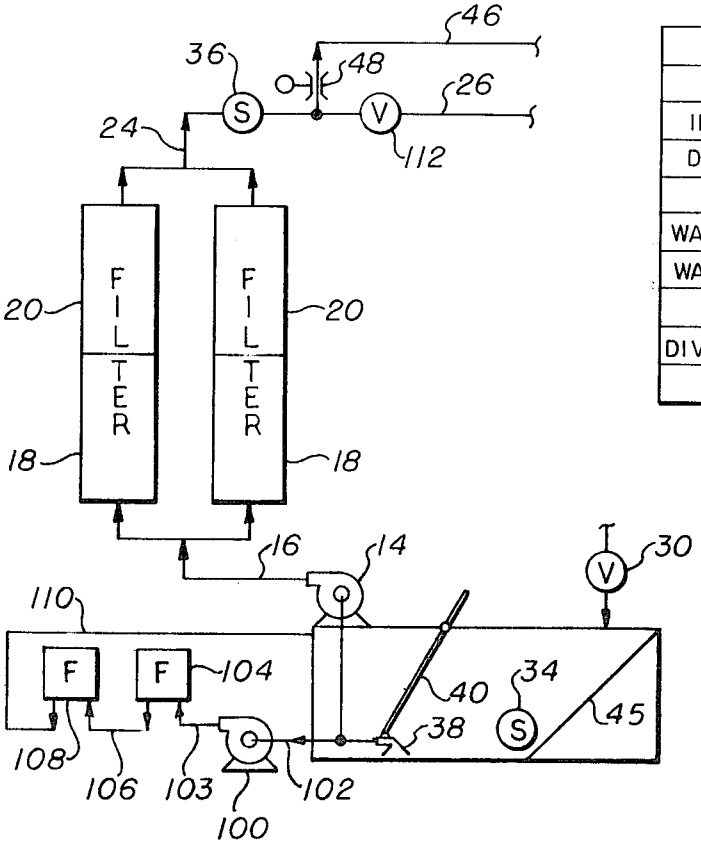
FIG. 3 is another embodiment of a second portion of the invention shown in FIG. 1.

As shown in FIG. 3, a third embodiment is provided wherein sump 12 has a sloping floor 43 disposed beneath outlet conduit so that the dense material will roll down toward inlet 38 of pump 14. The incline of the floor is such that the dense material is urged toward the inlet by gravity above.

A conduit 46 is mounted in fluid communication with conduit 26 and with a distilling apparatus 50 and a condenser 76 and a moisture separating apparatus 52 which are used to clean the re-cycling wash solvent. The distilling apparatus is used to remove from the solvent any hydrocarbons, such as oil or grease with radioactive contaminants dissolved therein and a moisture separating device is used to remove from the distilled solvent water with radioactive contaminates dissolved therein. Since distilling apparatus 50 can only distill specified quantities over a given period of time, metering orifice 48 is provided in conduit 46 to limit the flow of solvent. After passage through moisture separater 52, the clean solvent is carried by conduit 54 to sump 12 which is divided by dividing wall 56 into a first compartment 58 for receiving the re-cycling wash solvent and second compartment 60 for receiving the cleaned solvent. Although the preferred embodiment of the invention uses a single sump with two (2) compartments, the machine may be provided with two (2) separate sumps. A pump 62 is provided to receive the clean solvent from second compartment 60 for passage through conduit 64 and valve 65 to the top of drum 10 for addition of clean solvent thereto when the wash cycle has initially begun. Since the addition of this cleaned solvent will dilute any radioactive material carried in the re-cycling solvent, the solvent is continuously cleaned during both wash and dry cycles. Accordingly, it is necessary that cleaning means 50, 76, and 52 receive the re-cycling solvent during the cycles. Thus, a diverter valve 66 is provided in conduit 26 to prevent flow of solvent into drum during the dry cycle and excess filtered solvent flows back to sump 12 through conduit 67. Pump 14 is continuously activated so that the re-cycling solvent is continuously filtered and a portion of the solvent flows through conduit 46 through still 50, condensor 76 and moisture separater 52 into second compartment 60 during such dry cycle.

As shown in FIG. 3, the "hot" solvent in the first compartment 58 may also be continuously filtered by an add on pump 100 connected through conduits 102 to sump 12 for forcing the solvent through a conduit 103, a first filter 104, conduits 106, second filter 108 and returned to sump 12 via conduit 110. To prevent flow from drum 10 into filters 18 and 20 during the drying cycle, shut off valve 112 is disposed in conduit 26. The openings in filters are sufficiently small to remove substantially all of the particulate material suspended in the solvent, such as 0.5 microns. It is believed that this continuous filtering of the solvent during both wash and dry cycles, as well as the continuous flushing of the garments during the wash cycle, are the actions which are necessary to enable successful removal of the contaminates from the garments.

In order to enable drying of the garments within drum 10, a fan dryer 68 is provided in fluid communication with expansion bag 70 via conduit 72, valve 74 and with a condenser 76. This drying cycle and circuit is described in U.S. Pat. No. 3,728,074 which has been incorporated by reference and discloses the operation of this apparatus.

Figure 4:
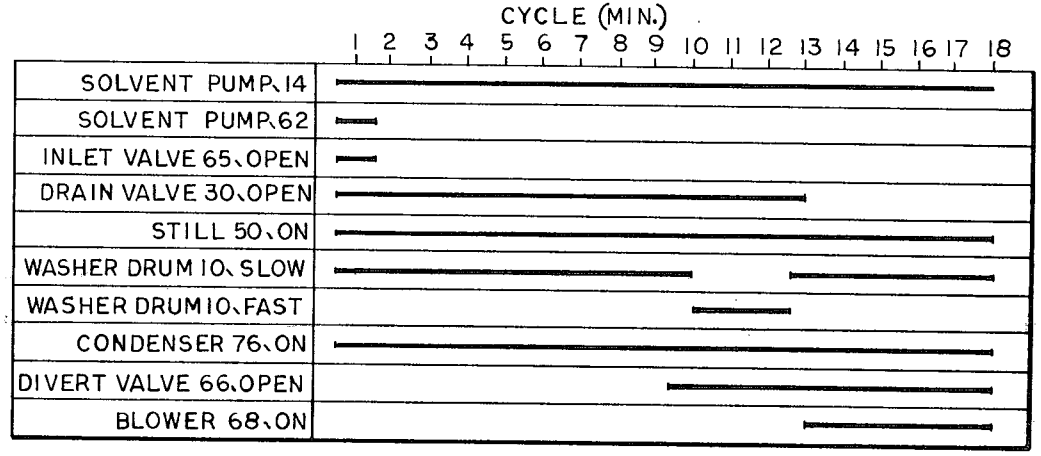
FIG. 4 is a diagram showing the sequence of operations of the parts of the invention during the wash and dry cycles.

The operation of the preferred embodiment for an eighteen minute operation cycle is best shown by referral to FIG. 4, wherein solvent pump 14, still 50 and condenser 76 are operated continuously over the wash and dry cycles. Clean solvent is added to drum 10 by opening valve 65 and and running pumps 62 for 1½ minutes at the beginning of the wash cycle, the valve is then closed to prevent flow toward the pumps. To flush the garments in drum 10 during the wash cycle, drain valve 30 remains open and diverter valve 66 directs the filtered solvent into the drum. Diverter valve 66 opens back to sump 12 prior to closing drain valve 30 in order to extract the solvent from the drum. Upon completion of the wash and extract cycles of drum 10, blower 68 is activated to dry the cleaned garments.

From the foregoing, it will be seen that this invention is one well adapted to attain all the ends and objects hereinabove set forth, together with other advantages which are obvious and which are inherent to the apparatus.

It will be understood that certain features and sub-combinations are of utility and may be employed with reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method of decontaminating radioactive garments, comprising the steps of:

depositing contaminated garments in a cleaning drum;

agitating the drum during a wash cycle to separate radioactive particulate material from the garments;

continuously removing a dry cleaning solvent from the drum during the wash cycle for storage in a sump;

continuously pumping solvent from the sump to the drum during the wash cycle for flushing the separated radioactive particulate material into the sump; and filtering the pumped solvent to remove the radioactive particulate material suspended in the solvent prior to addition to the drum.

2. The method of claim 1, including drying the garments upon completion of the wash cycle; and continuously cleaning a portion of the solvent during both the wash and dry cycles to remove radioactive material dissolved in the solvent.

3. The method of claim 2, including adding cleaned solvent to the drum at the beginning of the wash cycle to dilute any residual radioactive contamination supported by the solvent being pumped from the sump.

4. The method of claim 2 with the continuously cleaning including distilling the portion of solvent to remove oil and separating water from the portion of solvent.

5. The method of claim 1, including removing any radioactive particulate material which has settled out of the solvent in the sump.

6. The method of claim 1, including monitoring the amount of radioactivity in the sump and in the filtered solvent before and after filtration to ensure adequate filtering.

7. The method of claim 1, including filtering the solvent removed from the drum for removing lint before it enters the sump.

8. A method of decontaminating radioactive garments, comprising the steps of:

depositing contaminated garments in a cleaning drum;

agitating the drum during a wash cycle to separate radioactive particulate material from the garments;

continuously removing a dry cleaning solvent from the drum during the wash cycle for storage in a sump;

continuously pumping solvent from the sump to the drum during the wash cycle for flushing the separated radioactive particulate material into the sump;

filtering the pumped solvent to remove the radioactive particulate material suspended in the solvent prior to addition to the drum; and monitoring radioactive contamination in the cleaning solvent.

9. The method of claim 8, including the step of drying the garments upon completion of the wash cycle; and continuously cleaning a portion of the solvent during both the wash and dry cycles to remove radioactive material dissolved in the solvent.

10. The method of claim 9, including adding cleaned solvent to the drum at the beginning of the wash cycle to dilute any residual radioactive contamination supported by the solvent being pumped from the sump.

11. The method of claim 10 with the continuous cleaning, including distilling the portion of solvent to remove oil and separating water from the portion of solvent.

12. The method of claim 8, including removing any radioactive particulate material which has settled out of the solvent in the sump.

13. The method of claim 8, wherein the step of monitoring the radioactivity in the sump and in the filtered solvent is accomplished before and after filtration to ensure adequate filtering.

14. The method of claim 8, including filtering the solvent removed from the drum for removing lint before it enters the sump.

* * * * *